US006910508B2

(12) United States Patent
Knecht

(10) Patent No.: US 6,910,508 B2
(45) Date of Patent: Jun. 28, 2005

(54) METHOD FOR WEAVING A DOUBLE LAYER CLOTH

(75) Inventor: Willi Knecht, Jona (CH)

(73) Assignee: Sulzer Textil AG, Rüti (CH)

( * ) Notice: Subject to any disclaimer, the term of this patent is extended or adjusted under 35 U.S.C. 154(b) by 221 days.

(21) Appl. No.: 10/278,869

(22) Filed: Oct. 22, 2002

(65) Prior Publication Data

US 2003/0079794 A1 May 1, 2003

(30) Foreign Application Priority Data

Nov. 1, 2001 (EP) ..... 01811061

(51) Int. Cl.[7] ..... D03J 1/22

(52) U.S. Cl. ..... 139/291 C; 139/292; 139/294; 139/296; 139/298; 139/301

(58) Field of Search ..... 139/291 R, 292, 139/294–296, 298–301

(56) References Cited

U.S. PATENT DOCUMENTS

| | | | | | |
|---|---|---|---|---|---|
| 3,144,882 | A | * | 8/1964 | Steiner | 139/54 |
| 3,426,807 | A | * | 2/1969 | Pfarrwaller | 139/434 |
| 3,446,250 | A | * | 5/1969 | Pfarrwaller | 139/294 |
| 3,620,261 | A | * | 11/1971 | Bulcock | 139/295 |
| 3,672,407 | A | * | 6/1972 | Luber | 139/295 |
| 3,771,573 | A | * | 11/1973 | Horn et al. | 139/294 |
| 3,800,835 | A | * | 4/1974 | Riha et al. | 139/291 R |
| 3,885,600 | A | * | 5/1975 | Altmann | 139/292 |
| 3,943,978 | A | * | 3/1976 | Jindra | 139/292 |
| 3,967,655 | A | * | 7/1976 | Sejbal et al. | 139/291 R |
| 4,627,473 | A | * | 12/1986 | Ludwig | 139/294 |
| 4,919,171 | A | * | 4/1990 | Dornier | 139/435.1 |
| 5,092,371 | A | * | 3/1992 | Vandeputte | 139/298 |
| 5,651,395 | A | | 7/1997 | Graham et al. | |

FOREIGN PATENT DOCUMENTS

| | | |
|---|---|---|
| DE | 22 22 474 A | 11/1972 |
| DE | 23 28 244 A | 1/1974 |
| DE | 40 38 287 A | 6/1991 |
| JP | 11107135 A | 4/1999 |
| SU | 1703731 A1 | 1/1992 |

* cited by examiner

*Primary Examiner*—John J. Calvert
*Assistant Examiner*—Robert H. Muromoto, Jr.
(74) *Attorney, Agent, or Firm*—Townsend and Townsend and Crew LLP

(57) ABSTRACT

A method for weaving a double layer cloth (1, 2) for use in the manufacture of airbag cloths. It is carried out using a weaving machine which includes, between the weaving sley (3) and the cloth beam (10), a temple arrangement (4) which is arranged directly after a beat-up edge (30), a deflection element (5') for the cloth (1, 2) and a drive roller (6). The produced cloth is transported away from the beat-up edge with the drive roller and using suitable means in such a manner that both layers of the cloth—the lower cloth (2) and the upper cloth (1) respectively—are acted on by largely symmetrical forces. The cloth in the temple arrangement is drawn against frictional resistances through a gap (440) between two stationary surfaces and is at the same time stretched transversely to the transport direction by lateral temple arrangements (45). The cloth is driven by a rotatable pressing roller (5), which is used in addition to the drive roller, with the pressing roller, which forms the deflection element, cooperating in active contact with the drive roller.

13 Claims, 3 Drawing Sheets

Fig.4
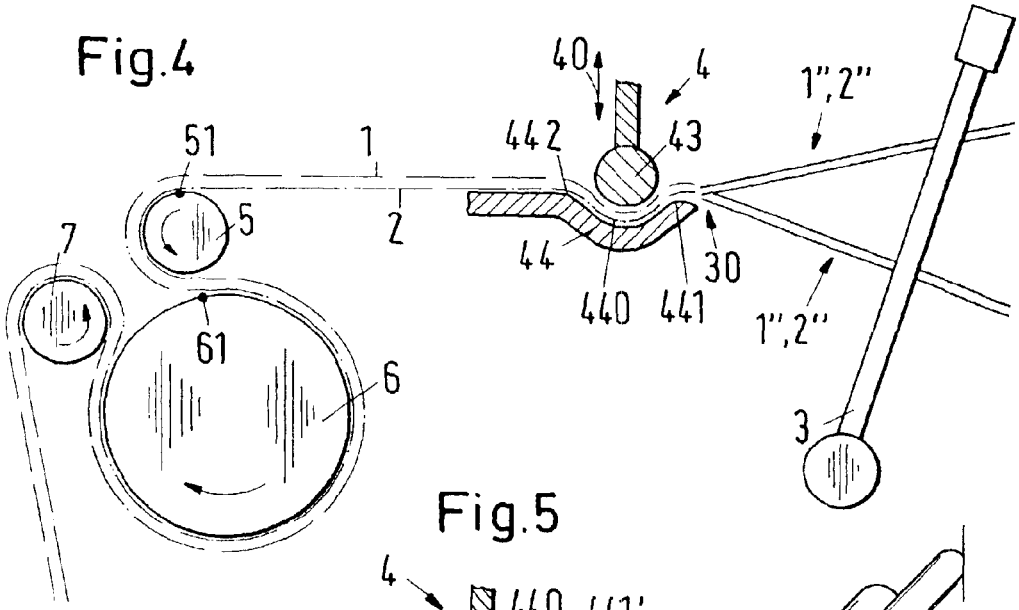
Fig.5
Fig.6
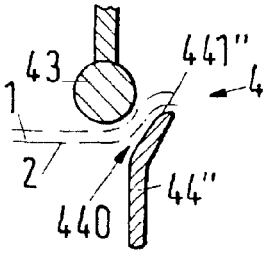
Fig.7
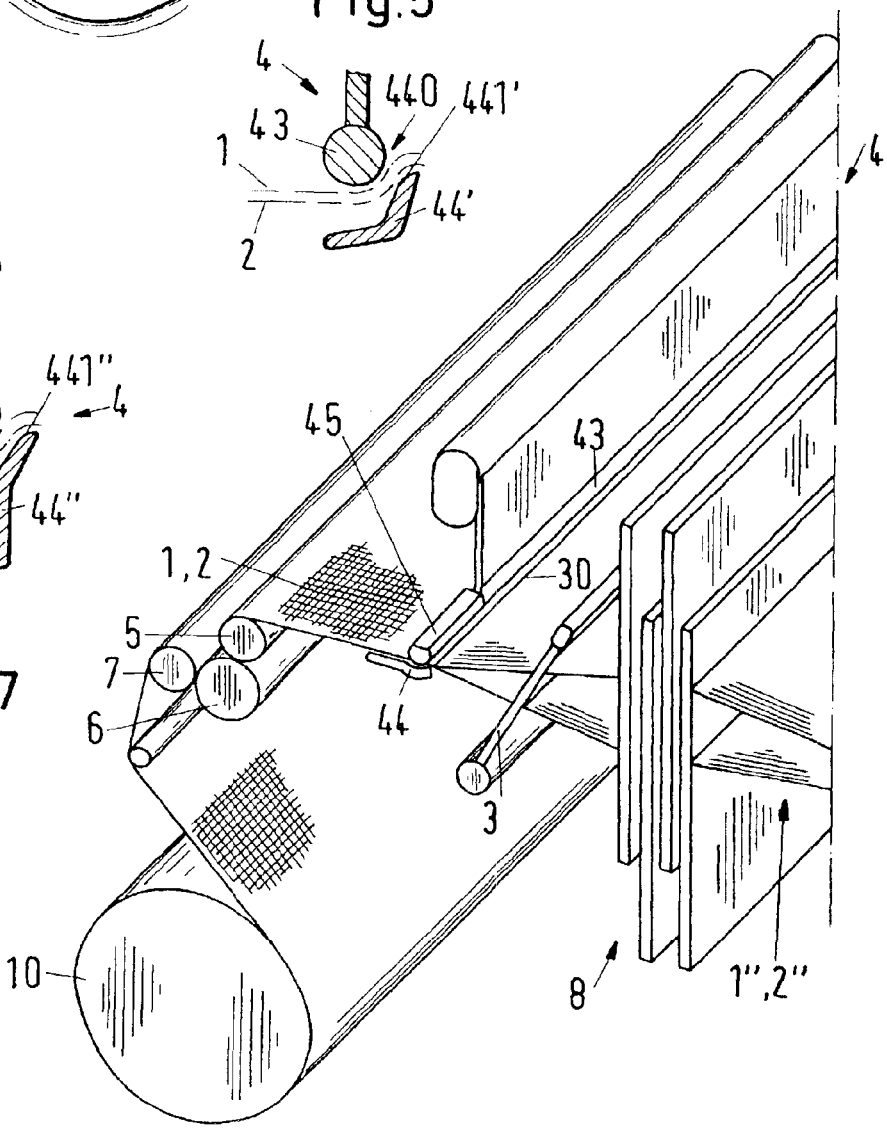

METHOD FOR WEAVING A DOUBLE LAYER CLOTH

BACKGROUND OF THE INVENTION

The invention relates to a method for weaving a double layer cloth and to uses of the method, in particular for manufacturing airbag cloths.

U.S. Pat. No. 5,651,395 describes methods for the manufacture of bags for airbags, with double layer cloths being produced for this manufacturing process. In cloths of this kind, two-layered regions can be distinguished from single-layer regions. The inflatable inner spaces of the bags are formed by the two-layered regions, which consist in each case of a lower and an upper cloth. In the single-layer regions, warp threads, which are located separately in the two-layer regions either in the upper or the lower cloth, are made to one another through technical binding measures to form a common partial cloth. The closed seams of the bags can be manufactured from the single-layer regions, which completely surround the two-layered ones.

High demands are placed on the quality of the double layer cloths, for example for airbags—i.e. on the so-called product rejection. The warp and weft threads must be uniformly and relatively densely arranged in the cloth. The deviation from a specified air permeability of the lower and the upper cloth respectively should be a minimum. The cloth layers must thus be as uniformly impermeable as possible. The threads used must be able to withstand high stresses in regard to tension and extension. The double layer cloth for airbags is a measured product, namely a cloth which is manufactured to an exact measure. On weaving machines which are equipped in the usual manner, the double layered nature has unfavorable effects on the product rejection when measured products are to be manufactured.

During the transport of the cloth by means of a drive roller (or a cloth draw-off beam) away from the location at which the weft threads are inserted and beaten up (beat-up edge, cloth edge), the cloth layers are mutually displaced, which leads to disadvantageous transverse folds. The non-uniform transport of the two layers arises in a so-called bar temple or spreader bar, which is usually used for the positioning of the beat-up edge and the spreading of the cloth. A spreader bar with left-hand/right-hand thread, which is arranged before the drive roller, additionally contributes to the formation of folds.

A method is also known from SU-A-1703731 by means of which the formation of folds could be prevented. In this method, however, needles are stuck into the cloth, which would impair the impermeability of the airbag.

SUMMARY OF THE INVENTION

It is an object of the invention to create an improved method for weaving a double layer cloth in which the disadvantageous formation of folds is avoided or lessened.

The method for weaving a double layer cloth serves in particular for the manufacture of airbag cloths. It is carried out using a weaving machine which includes, between the weaving sley and the cloth beam, a temple arrangement which is arranged directly after a beat-up edge, a deflection element for the cloth and a drive roller. The produced cloth is transported away from the beat-up edge with the drive roller and using suitable means in such a manner that both layers of the cloth—the lower cloth and the upper cloth respectively—are acted on by largely symmetrical forces.

The cloth in the temple arrangement is drawn against frictional resistances through a gap between two stationary surfaces and is at the same time stretched transversely to the transport direction by lateral temple arrangements. The cloth is driven by a rotatable pressing roller, which is used in addition to the drive roller, with the pressing roller, which forms the deflection element, cooperating with the drive roller.

The invention will be explained in the following with reference to the drawings.

BRIEF DESCRIPTION OF THE DRAWINGS

FIG. 4 shows a cloth draw-off in a weaving machine which uses a temple arrangement in accordance with the present invention, FIGS. 5, 6 show two variant forms of the temple arrangement, FIG. 7 is a partial illustration of the weaving machine of FIG. 4.

DESCRIPTION OF THE PREFERRED EMBODIMENTS

Figure 1:
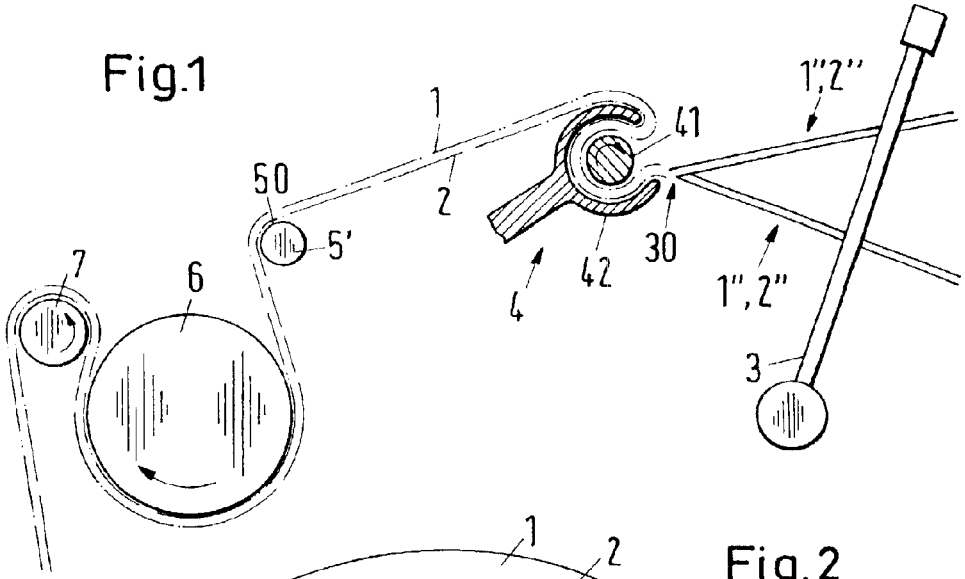
FIG. 1 is a partial, schematic illustration of a weaving machine with a cloth draw-off process being practiced, in which a disadvantageous development of folds arises.

FIG. 1 illustrates schematically and only partly a weaving machine in which a cloth draw-off is associated with the occurrence of disadvantageous fold formation. Shown are warp threads 1" for an upper shed and warp threads 2" for a lower shed and a sley 3 for the beating up of non-illustrated weft threads, with which, together with the warp threads 1" on the one hand and the warp threads 2" on the other hand, the upper cloth 1 and the lower cloth 2 are respectively manufactured. Shown in addition are: a beat-up edge 30; a bar temple 4, which is illustrated in more detail in FIG. 2; a bar-shaped deflection element 5' for the cloth layers 1 and 2; a drive roller 6 and a pressing roller 7, following which is a non-illustrated cloth beam (e.g. cloth beam 10 in FIG. 7).

Figure 2:
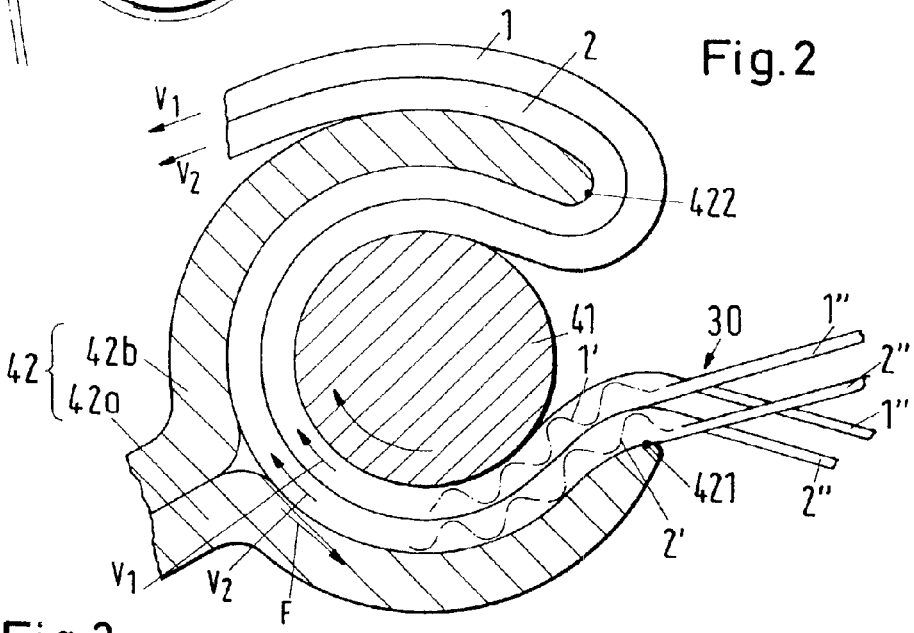
FIG. 2 is a cross-section through a bar temple which is used in the weaving machine of FIG. 1.

The bar temple 4, the cross-section of which can be seen in FIG. 2, comprises a rotatable bar 41 which is driven through the cloth layer 1 and a support pan 42 which is composed of two parts 42*a* and 42*b*. The warp threads 1" and 2", which are bound in into the cloths 1 and 2, are indicated by wavy lines 1' and 2'. The upper cloth 1 moves with a velocity $v_1$, the lower cloth 2 with a velocity $v_2$. The cloths 1 and 2 are pressed against the support pan 42 by the bar 41. Since frictional forces F act between the lower cloth 2 and the support pan 42 and since the bar 41 executes a rotational movement corresponding to the velocity $v_1$, $v_1$ is somewhat greater than $v_2$; there is thus a displacement between the two cloths 1 and 2. This disadvantageous displacement effect is the most highly pronounced at the deflection points 421 and 422 ("stagnation points"). The deflection element 5' also contributes to the displacement effect at a "stagnation point" 50.

Figure 3:
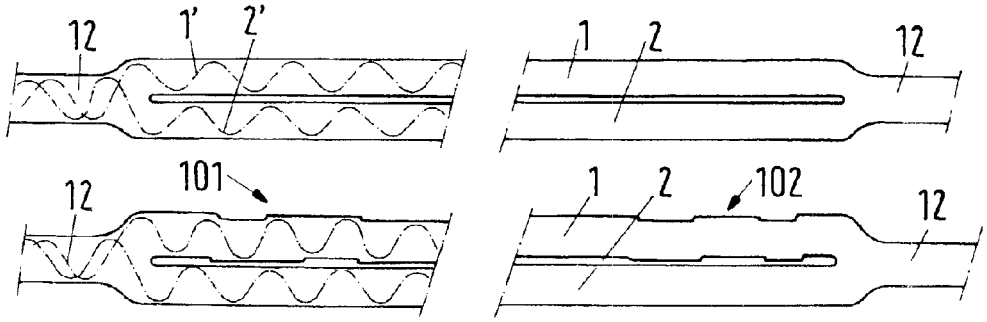
FIG. 3 shows two longitudinal sections through airbags which are manufactured of double layer cloth.

FIG. 3 shows, by means of two longitudinal sections through double layer cloths 1, 2, at the top, a product (airbag) as it should look in the ideal case and, at the bottom, a product (schematically illustrated) as it actually arises as a result of the displacement effects. The warp threads 1' and 2' are made to cross locally through technical binding measures to form common cloth parts 12 for the purpose of producing seams. Zones 101 and 102 in which folds arise can be recognized mainly at the edge of these locations.

A cloth draw-off in a weaving machine in which the method in accordance with the invention is used is shown in FIG. 4. In this method for weaving a double layer cloth, the produced cloth 1, 2 is transported away from the beat-up edge 30 with the drive roller 6 and using suitable means in such a manner that the two layers 1 and 2 of the cloth are acted on by largely symmetrical forces. These suitable means consist of special temple arrangement 4 and a deflection element which is formed as a pressing roller 5. In the temple arrangement 4 the cloth 1, 2 is drawn against frictional resistances through a gap 440 between two stationary surfaces.

The gap 440 of the temple arrangement 4 lies between a bar 43 and a support pan 44, which is for example formed in the shape of a trough. The cloth 1, 2 is held down by the bar 43 and is pressed onto rounded deflection edges 441 and 442 of the support pan 44. In the active region of the bar 43 the support pan 44 is shaped concavely and formed in such a manner that its shape fits in a complementary manner with the shape of the bar 43 inclusive of the cloth 1, 2 lying thereon. The convexly shaped deflection edges 441 and 442 form the entrance and exit regions respectively of the gap 440, so that the cloth 1, 2 is in each case transported horizontally at the entrance and at the exit. The bar 43, the position of which can be adjusted (indicated by the double arrow 40), is pressed so strongly downwards that the friction which acts between the upper cloth 1 and the bar 43 is approximately of a strength equal to the friction acting between the lower cloth 2 and the support pan 44. In this the lower cloth 2 need not make contact with the concave middle region of the support pan 44.

The pressing roller 5 is in active contact with the drive roller 6: The pressing roller 5 is arranged with respect to the drive roller 6 in such a manner that the cloth 1, 2 on the pressing roller 5 is in contact with the latter along a wrap-around angle of at least 170°. A torque is exerted by the drive roller 6 on the pressing roller 5 via the cloth 1, 2 which lies between them. As a result of this arrangement the pressing roller 5 exerts a drawing force on the lower cloth 2 from a drive point 51; the drive roller 6 exerts a drawing force on the upper cloth 1 from a drive point 61. The pressing roller 5 is advantageously pressed so strongly against the drive roller 6 that the two named drawing forces are largely of equal magnitude. The value of the wrap-around angle at the pressing roller 5 advantageously lies in the range between 170° and 190°.

FIGS. 5 and 6 represent two variant forms of the temple arrangement 4. In these temple arrangements 4 the gap 440 is in each case formed by the bar 43 and a bar section 44' with only one deflection edge 441' or a bar section 44" with a deflection edge 441" respectively. Here as well the bar 43 is disposed in such a manner that its position is adjustable. The adjustment can be made both in the vertical and in the horizontal direction.

FIG. 7 is a partial illustration of the weaving machine of FIG. 4. Here it can be seen that the temple arrangement 4 stretches the cloth 1, 2 transversely to the transport direction with lateral temples 45. The warp threads 1" and 2" are moved by shafts 8. A double cloth can be produced which has closed regions in the warp direction, on the one hand laterally, and on the other hand at periodic spacings, so that rectangular bags or hollow cloth sections, in particular rectangular airbags, can be manufactured from the product. Folds such as result with the weaving machine of FIG. 1 do not arise with the weaving machine which is shown in FIG. 7—when correctly set—or form to a substantially lesser extent.

Figure 8:
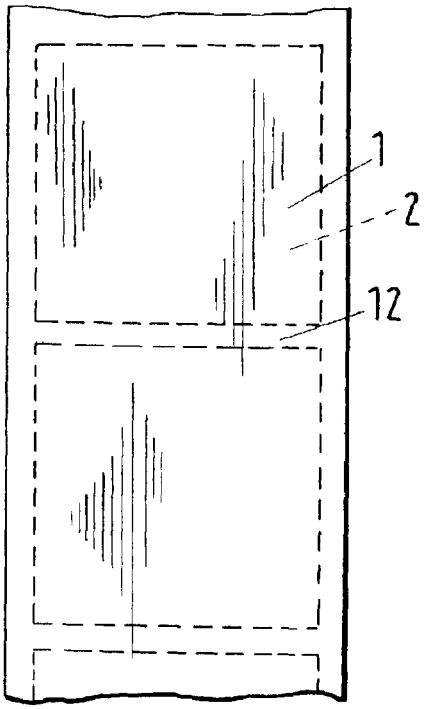
FIG. 8 shows a first product made with the method of the present invention, from which rectangular bags or hollow cloth sections can be manufactured.
Figure 9:
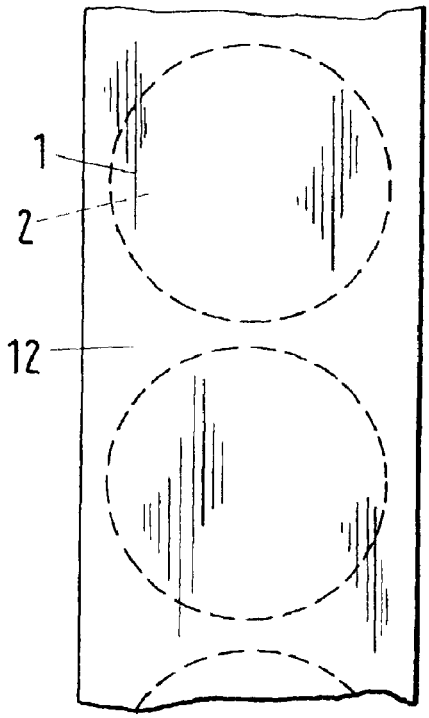
FIG. 9 shows a second product for the manufacture of round bags or of hollow cloth sections.

In FIG. 8 a first product of the method in accordance with the invention, from which rectangular bags or hollow cloth sections can be manufactured, is illustrated in a schematic drawing. FIG. 9 shows a second product for the manufacture of round bags or hollow cloth sections. In the manufacture of these products the warp threads are moved for example using a Jacquard machine and/or another shed forming device.

What is claimed is:

1. A method for weaving double layer cloth formed by first and second fabric layers on a weaving machine having a weaving sley acting on the cloth at a beat-up edge, a temple arrangement immediately following the beat-up edge past which the cloth is transported towards a cloth take-up beam, a deflection roller over which the cloth is transported, and a drive roller for moving the cloth from the beat-up edge towards the cloth beam, the method comprising forming the temple arrangement so that it has first and second, spaced-apart, stationary temple surfaces defining a gap between them, extending the cloth through the gap, guiding the cloth about the deflection roller and contacting the first fabric layer with a surface of the deflection roller, guiding the cloth about the drive roller and contacting the second fabric layer with a surface of the drive roller, setting the gap between the stationary surfaces so that the stationary surfaces apply a force against the cloth and generate frictional forces between the first and second fabric layers and the respective stationary temple surfaces, and biasing the deflection roller against the drive roller so that respective surfaces of the deflection roller and the drive roller frictionally engage the first and second fabric layers, respectively, and generate substantially symmetrical transport, forces in the first and second fabric layers for overcoming the frictional forces and moving the cloth towards the cloth beam.

2. A method according to claim 1 including stretching the cloth in a lateral direction transverse to the transport direction.

3. A method according to claim 2 wherein the cloth is stretched in the lateral direction at the temple arrangement.

4. A method according to claim 1 wherein the first temple surface is formed by an elongated bar and the second temple surface is formed by at least one stationary deflection edge, and including changing a position of the bar relative to the at least one deflection edge.

5. A method according to claim 4 including forming the second temple surface so it defines a support pan defining two, spaced-apart deflection edges, providing the support pan with a trough shape which is complementary to a shape of the bar and the cloth in the gap between the bar and the support pan, and pressing the cloth with the bar onto the deflection edges of the support pan.

6. A method according to claim 5 and providing the trough-shaped support pan with a concave middle region and convex entrance and exit regions to the gap, and arranging the entrance and exit regions so that the cloth enters and exits the gap in substantially parallel directions.

7. A method according to claim 1 wherein guiding the cloth about the deflection roller and about the drive roller includes extending the first fabric layer about the deflection roller over a wrap-around angle of at least about 170°, and arranging the deflection roller and the drive roller so that a torque generated by the drive, roller is transmitted to the deflection roller when the rollers press against the cloth between them.

8. A method according to claim 7 wherein the torque transferred from the drive roller to the deflection roller is chosen so that a transport force exerted by the deflection roller on the first fabric layer is of substantially the same magnitude as the transport force exerted by the drive roller on the second fabric layer.

9. A method according to claim 7 wherein the wrap-around angle is in the range between about 170° to 190°.

10. A method for weaving double layer cloth formed by first and second fabric layers on a weaving machine having a weaving sley acting on a cloth at a beat-up edge, the method comprising arranging first and second, opposite and spaced-apart stationary temple surfaces downstream of the beat-up edge for receiving the cloth and guiding it in a downstream direction, adjusting the spacing between the temple surfaces until they compress the cloth between them so as to generate friction between the cloth and the temple surfaces, training the cloth at a location downstream of the temple surfaces about a deflection roller so that the first fabric layer is in contact with a surface of the deflection roller, guiding the cloth about a drive roller located downstream of the temple surfaces so that the second fabric layer is in contact with a surface of the drive roller, arranging the deflection roller and the drive roller so that the cloth is disposed between the surfaces of the rollers and the surfaces press against the cloth to generate friction between the deflection roller and the first fabric layer and between the drive roller and the second fabric layer, rotating the drive roller while pressing the respective roller surfaces against the first and second fabric layers to transfer torque from the drive roller to the deflection roller and cause the rollers to generate substantially symmetrical forces in the first and second fabric layers sufficient to overcome the friction between the cloth and the temple surfaces and move the cloth away from the temple surfaces, and spreading the cloth at the temple surfaces in a lateral direction transverse to the direction in which the cloth moves.

11. A method for weaving bags and hollow sections formed by first and second fabric layers on a weaving machine having a weaving sley acting on the fabric layers at a beat-up edge, a temple arrangement immediately following the beat-up edge past which the first and second fabric layers are transported towards a take-up beam, a deflection roller about which the first and second fabric layers are transported, and a drive roller for moving the first and second fabric layers from the beat-up edge towards the beam, the method comprising forming the temple arrangement so that it has first and second, spaced-apart, stationary temple surfaces defining a gap between them, extending the first and second fabric layers through the gap, guiding the first and second fabric layers about the deflection roller and contacting the first fabric layer with a surface of the deflection roller, guiding the first and second fabric layers about the drive roller and contacting the second fabric layer with a surface of the drive roller, setting the gap between the temple surfaces so that the temple surfaces apply a force against the first and second fabric layers and generate frictional forces between the first and second fabric layers and the respective temple surfaces, and biasing the deflection roller against the drive roll so that respective surfaces of the deflection roller and the drive roller frictionally engage the first and second fabric layers, respectively, and generate substantially symmetrical transport forces in the first and second fabric layers for overcoming the frictional forces and moving the cloth towards the beam.

12. A method according to claim 11 wherein each fabric layer has warp threads and the method includes moving the warp threads with shafts, controlling the shafts with a shaft or cam machine, producing the first and second fabric layers as a double layer cloth which has partial surfaces which are closed laterally relative to a warp direction and at periodic spacings, and manufacturing rectangular bags from the double layer cloth.

13. A method according to claim 11 wherein each fabric layer has warp threads and the method includes moving the warp threads with a Jacquard machine, producing the first and second fabric layers as a double layer cloth which has round, closed boundary zones, and manufacturing round bags from the double layer cloth.

* * * * *